US006356244B1

(12) United States Patent
Mizuno et al.

(10) Patent No.: US 6,356,244 B1
(45) Date of Patent: Mar. 12, 2002

(54) ANTENNA DEVICE

(75) Inventors: Kazuyuki Mizuno, Tokoname; Yasuhiko Mizutani, Komaki; Takami Hirai, Aichi-pref.; Hiroyuki Arai, 615-11, Imajukuhigashi-cho, Asahi-ku, Yokohama-city, Kanagawa-pref. 241-0032, all of (JP)

(73) Assignees: NGK Insulators, Ltd., Nagoya; Hiroyuki Arai, Yokohama, both of (JP)

( * ) Notice: Subject to any disclaimer, the term of this patent is extended or adjusted under 35 U.S.C. 154(b) by 0 days.

(21) Appl. No.: 09/531,289

(22) Filed: Mar. 20, 2000

(30) Foreign Application Priority Data

Mar. 30, 1999 (JP) ..... 11-089621

(51) Int. Cl.[7] ..... H01Q 1/360; H01Q 11/080

(52) U.S. Cl. ..... 343/895; 343/700 MS; 343/702

(58) Field of Search ..... 343/895, 700 MS, 343/702, 725, 846, 701, 850, 860, 806, 849

(56) References Cited

U.S. PATENT DOCUMENTS 5,198,831 A * 3/1993 Burrell et al. ..... 343/895
5,510,802 A * 4/1996 Tsurs et al. ..... 343/700 MS
5,635,945 A * 6/1997 McConnell et al. ..... 343/985
5,936,583 A * 8/1999 Sekine et al. ..... 343/702
6,046,700 A * 4/2000 Kitchener et al. ..... 343/725
6,124,831 A * 9/2000 Rutkowski et al. .. 343/700 MS

FOREIGN PATENT DOCUMENTS

| | | |
|---|---|---|
| JP | 9-162633 | 6/1997 |
| JP | 10-32413 | 2/1998 |
| JP | 10-41722 | 2/1998 |

* cited by examiner

*Primary Examiner*—Don Wong
*Assistant Examiner*—Chuc Tran D
(74) *Attorney, Agent, or Firm*—Burr & Brown

(57) ABSTRACT

An antenna device comprises an antenna section and a filter section which are formed in an integrated manner in a dielectric substrate, wherein the antenna section and the filter section are coupled to one another via a capacitance. Further, $0.3 \times Lr \leqq Lt \leqq 1.2 \times Lr$ is satisfied provided that an antenna length of the antenna section is Lt, and an antenna length measured for a single antenna is Lr. Accordingly, it is possible to realize a small size of the antenna device while avoiding the decrease in gain and the disadvantage of narrow band.

10 Claims, 14 Drawing Sheets

10B
12
24
20
S1
38
S2
32
40
S3
S4
30a
30b
S5
16
14
S6
22a
22b
18
S7
34
34a
34c
34b
S8
36a
36b
S9
S10

ANTENNA DEVICE

BACKGROUND OF THE INVENTION

1. Field of the Invention

The present invention relates to an antenna device comprising an antenna pattern based on an electrode film formed on a dielectric substrate.

2. Description of the Related Art

In order to realize a small size of the antenna device and realize a small size of the communication apparatus, a large number of devices have been hitherto suggested, in which, for example, an antenna pattern based on an electrode film is formed on the surface of a dielectric substrate (see, for example, Japanese Laid-Open Patent Publication Nos. 10-41722, 9-162633, and 10-32413).

Most of the antenna devices can be used by being directly mounted on a circuit board. This fact is an advantage of such antenna devices.

However, the antenna device, which includes the antenna pattern based on the electrode film formed on the surface of the dielectric substrate, involves the following inconvenience. That is, usually, when the device is made compact, then the gain is decreased, and the band is consequently narrowed.

SUMMARY OF THE INVENTION

The present invention has been made in view of the points as described above, an object of which is to provide an antenna device which makes it possible to realize a small size while avoiding the decrease in gain and the disadvantage of narrow band.

According to the present invention, there is provided an antenna device comprising an antenna section and a filter section which are formed integrally in a dielectric substrate, wherein the antenna section and the filter section are coupled to one another via a capacitance.

When the antenna section and the filter section are integrated into one unit with the capacitance intervening therebetween, the antenna length is theoretically determined in conformity with the center frequency of the filter section.

The size of the antenna section is dominant as compared with the size of the filter section, in the antenna device in which the antenna section and the filter section are integrated into one unit. Therefore, it is clear from the form or shape thereof that the size of the antenna device greatly depends on the antenna length (wavelength).

Further, it is known for the antenna that the small size causes the decrease in gain and the disadvantage of narrow band.

However, according to the present invention, it has been revealed that the input impedance of the antenna device is not changed even if the antenna length is changed when the antenna device is produced by integrating the antenna section and the filter section into one unit with the capacitance intervening therebetween.

Accordingly, for example, when the antenna length of the antenna section is shortened, it is possible to suppress the decrease in gain to be minimum. The advantage that the input impedance of the antenna device is not changed even when the antenna length is changed results in the successful improvement in yield by adjusting the antenna length during the production step.

It is also preferable for the device constructed as described above that $0.3 \times Lr \leqq Lt \leqq 1.2 \times Lr$ is satisfied provided that an antenna length of the antenna section is Lt, and an antenna length measured for a single antenna is Lr.

The reason why the antenna length Lt of the antenna section includes the portion in the range in which it is longer than the antenna length Lr of the single antenna is as follows. That is, although the effect of realization of the compact size is reduced, another effect is obtained such that the margin for mass production is increased when the device is designed, because the change of gain is small even when the antenna length is changed.

The antenna length Lt of the antenna section preferably satisfies $0.6 \times Lr \leqq Lt \leqq 1.2 \times Lr$, and more preferably $0.75 \times Lr \leqq Lt \leqq Lr$.

An antenna for constructing the antenna section may be a monopole antenna, or it may be an antenna having a meander line configuration. Alternatively, the antenna may be an antenna having a helical configuration.

It is also preferable that a length of a resonator disposed on an input side of the filter section is different from a length of a resonator disposed on an output side.

Accordingly, it is possible to counteract the difference in resonance frequency between the respective resonators, which would be otherwise caused by any mismatch between respective impedances on the antenna side and the external circuit side of the filter section. Thus, it is possible to obtain the filter section which has good attenuation characteristics. This results in the high quality of the antenna device.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Illustrative embodiments of the antenna device according to the present invention will be explained below with reference to FIGS. 1 to 14B.

Figure 1:
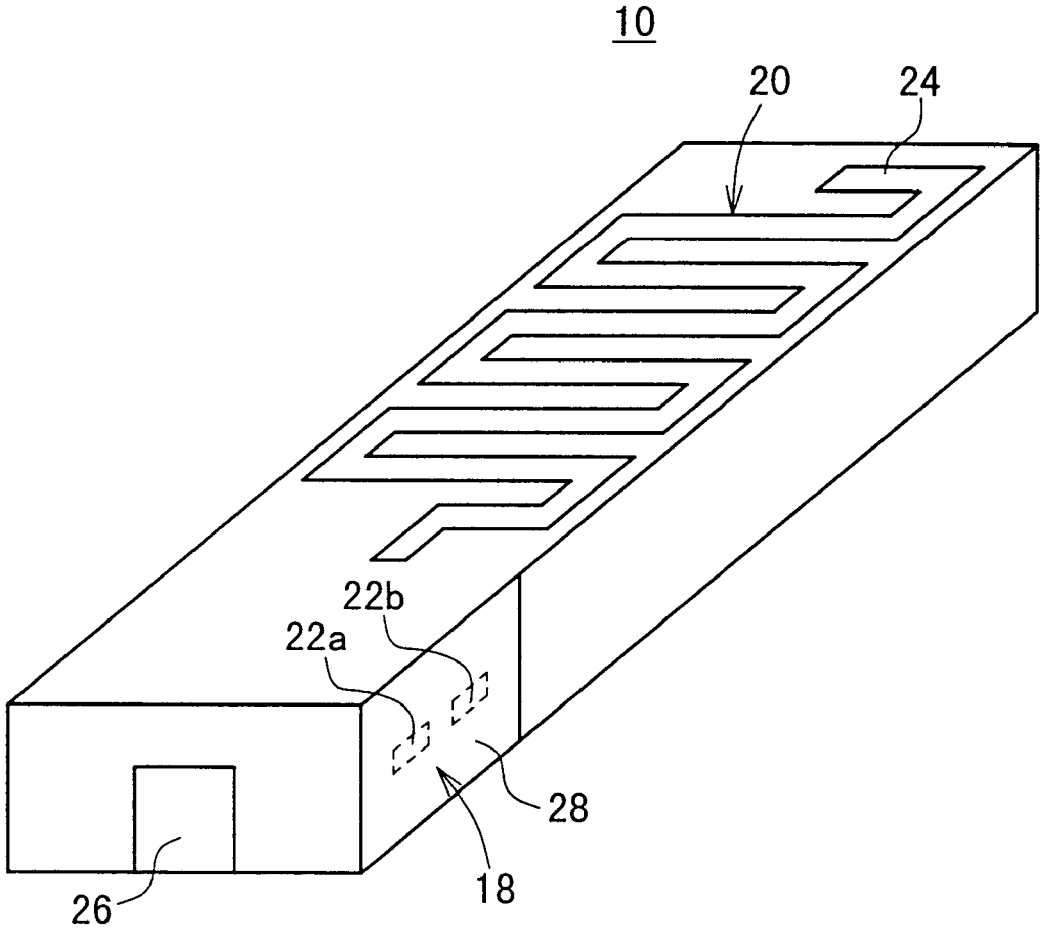
FIG. 1 shows a perspective view illustrating an antenna device according to an embodiment of the present invention.
Figure 2:
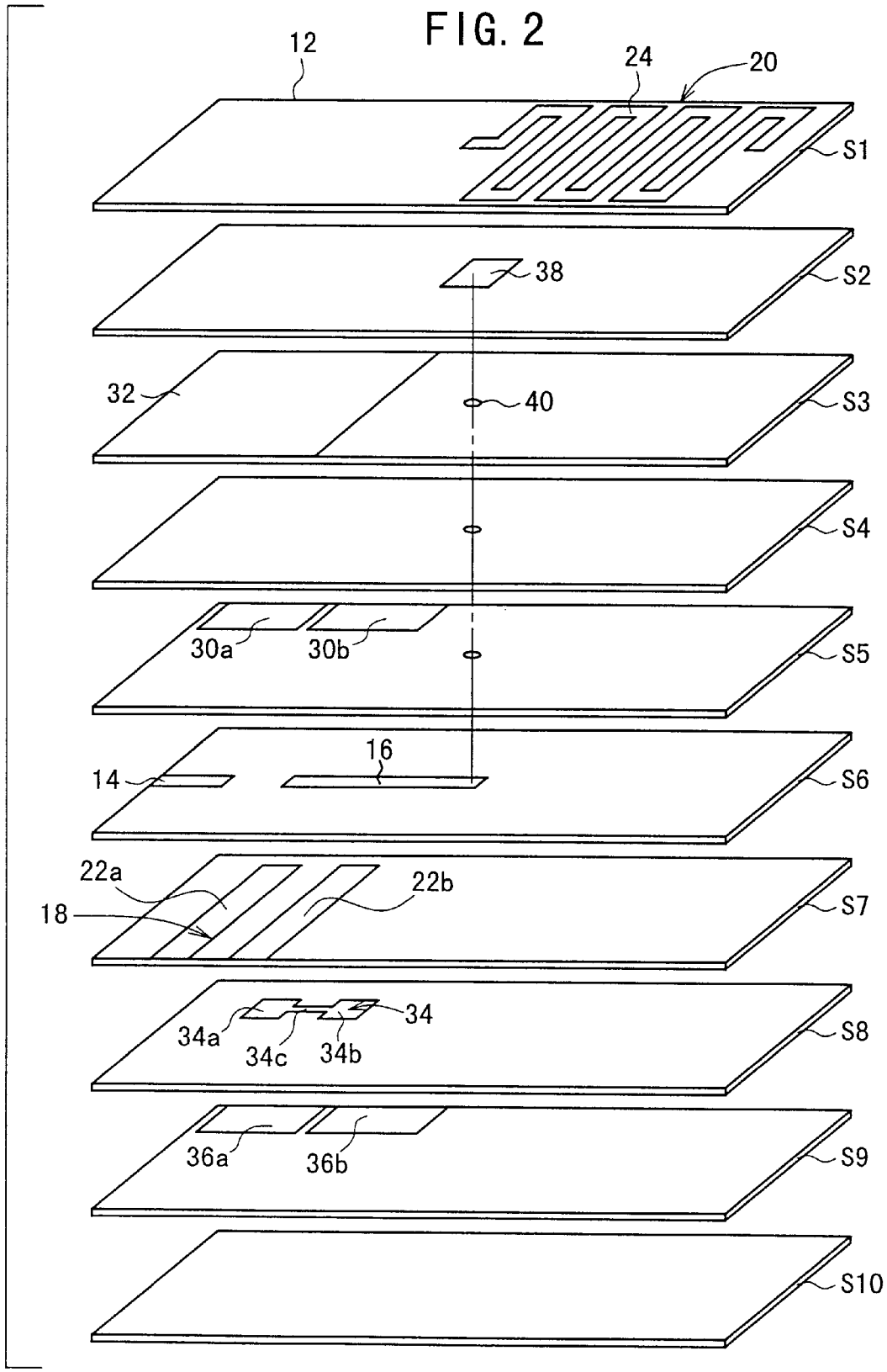
FIG. 2 shows an exploded perspective view illustrating the antenna device according to the embodiment of the present invention.

As shown in FIGS. 1 and 2, an antenna device 10A according to a first embodiment is composed of a dielectric substrate 12 comprising a plurality of stacked and sintered plate-shaped dielectric layers, which is formed with, in an integrated manner, a filter section 18 including an input/output electrode 14 disposed on the circuit side and an input/output electrode 16 disposed on the antenna side (see FIG. 2), and an antenna section 20 connected via the capacitance to the input/output electrode 16 disposed on the antenna side of the filter section 18. In the following description, the input/output electrode 14, which is disposed on the circuit side, is referred to as "first input/output electrode 14", and the input/output electrode 16, which is disposed on the antenna side, is referred to as "second input/output electrode 16".

The filter section 18 comprises two one-end-open type ¼ wavelength resonator elements 22*a*, 22*b* which are formed in parallel to one another respectively. The antenna section 20 has an antenna 24 which is composed of an electrode film formed to have a meander line configuration on the upper surface of the dielectric substrate 12.

As shown in FIGS. 1 and 2, the antenna device 10A according to the first embodiment is formed with an input/output terminal 26 which is connected to the first input/output electrode 14 of the filter section 18. Ground electrodes 28 are formed at portions corresponding to the filter section 18, on the right side surface and the left side surface of the dielectric substrate 12 respectively.

Specifically, as shown in FIG. 2, the dielectric substrate 12 comprises first to tenth dielectric layers S1 to S10 which are stacked and superimposed in this order from the top. Each of the first to tenth dielectric layers S1 to S10 is composed of one layer or a plurality of layers.

The antenna section 20 and the filter section 18 are formed in regions which are separated from each other as viewed in a plan view. The antenna section 20 is formed on the upper surface of the first dielectric layer S1. The filter section 18 is formed over a range from the third dielectric layer S3 to the tenth dielectric layer S10.

As shown in FIG. 2, the antenna device 10A according to the first embodiment comprises two resonator elements (first and second resonator elements 22*a*, 22*b*) which are formed in parallel to one another on the first principal surface of the seventh dielectric layer S7. Respective first ends of the resonator elements 22*a*, 22*b* are open, and respective second ends thereof form the short circuit with the ground electrode 28.

The components, which are formed on the first principal surface of the sixth dielectric layer S6, are the first input/output electrode 14 which has a first end connected to the input/output terminal 26 and which is capacitively coupled to the first resonator element 22*a*, and the second input/output electrode 16 which has a first end connected to the antenna section 20 via the capacitance and which has a second end capacitively coupled to the second resonator element 22*b*.

Two inner layer ground electrodes 30*a*, 30*b*, which are opposed to the respective open ends of the two resonator elements 22*a*, 22*b*, are formed on the first principal surface of the fifth dielectric layer S5 respectively.

An inner layer ground electrode 32, which is connected to the ground electrode 28 disposed on the outer surface, is formed of a portion of the first principal surface of the third dielectric layer S3 corresponding to the filter section 18.

A coupling-adjusting electrode 34, which is in a potentially floating state, for example, with respect to the ground electrode 28 and the input/output terminal 26 of the filter section 18, is formed on the first principal surface of the eighth dielectric layer S8.

The coupling-adjusting electrode 34 is shaped such that a first main electrode body 34*a* opposed to the first resonator element 22*a* and a second main electrode body 34*b* opposed to the second resonator element 22*b* are electrically connected to one another with a lead electrode 34*c* formed therebetween.

Two inner layer ground electrodes 36*a*, 36*b*, which are opposed to the respective open ends of the two resonator elements 22*a*, 22*b*, are formed on the first principal surface of the ninth dielectric layer S9 respectively.

As shown in FIGS. 1 and 2, the antenna device 10A according to the first embodiment includes an electrode 38 which is formed on the first principal surface of the second dielectric layer S2 to form the capacitance between the second input/output electrode 16 and the first end of the antenna 24. The electrode 38 is electrically connected to the second input/output electrode 16 via a through-hole 40.

Figure 3:
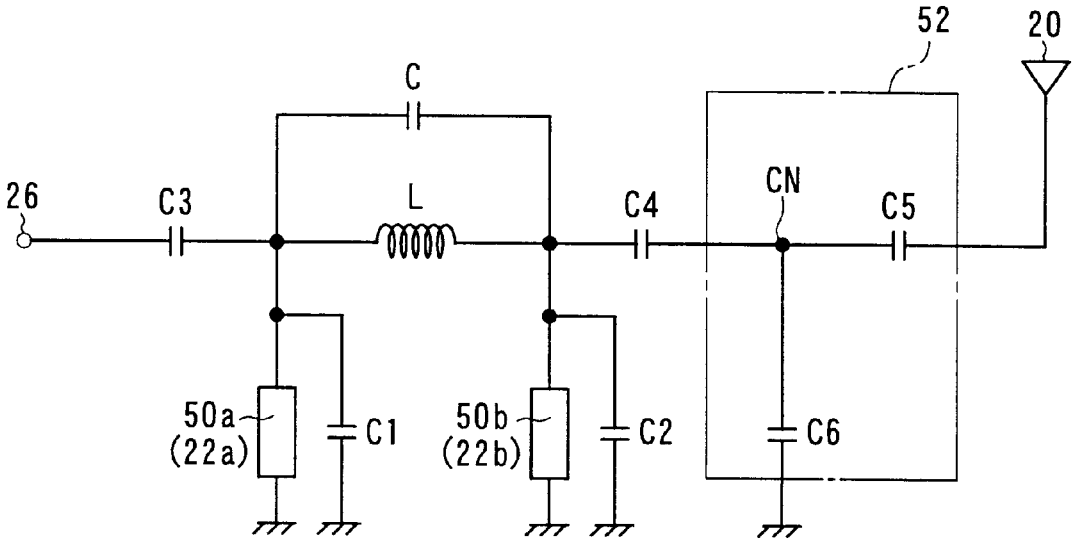
FIG. 3 shows an equivalent circuit diagram illustrating the antenna device according to the embodiment of the present invention.

The electric coupling among the respective electrodes of the antenna device 10A according to the first embodiment will now be explained with reference to an equivalent circuit diagram shown in FIG. 3.

Two resonators 50*a*, 50*b*, which are based on the first and second resonator elements 22*a*, 22*b*, are connected in parallel between the input/output terminal 26 and the ground respectively. The adjoining resonators 50*a*, 50*b* are inductively coupled to one another. Accordingly, on the equivalent circuit, an inductance L is consequently inserted between the adjoining resonators 50*a*, 50*b*.

A combined capacitance C, which is based on the coupling-adjusting electrode 34, is formed between the first resonator element 22*a* and the second resonator element 22*b*. An LC parallel resonance circuit, which is based on the inductance L and the capacitance C, is consequently connected between the respective resonators 50*a*, 50*b*.

Capacitances (combined capacitances) C1, C2 are formed between the respective open ends of the first and second resonator elements 22*a*, 22*b* and the corresponding inner layer ground electrodes 30*a*, 36*a* and 30*b*, 36*b* respectively.

A capacitance C3 is formed via the first input/output electrode 14 between the first resonator element 22*a* and the input/output terminal 26. A capacitance C4 is formed between the second resonator element 22*b* and the second input/output electrode 16 for constructing a contact CN. A capacitance C5 is formed via the electrode 38 between the contact CN (second input/output electrode 16) and the antenna section 20. A capacitance C6 is formed between the contact CN (second input/output electrode 16) and the ground (ground electrode 32).

That is, the antenna device 10A according to the first embodiment is constructed such that the filter section 18 and the antenna section 20 are coupled to one another via the capacitance C5 (and C4). Especially, the circuit is constructed such that an impedance-matching circuit 52, which is composed of the capacitances C5, C6, is inserted and connected between the filter section 18 and the antenna section 20. It is also possible to realize the impedance matching by changing the length of the resonators 50*a*, 50*b*, or varying the capacitances C1, C2 shown in FIG. 3, in place of the capacitance C6.

It has been revealed for the antenna device 10A according to the first embodiment that the input impedance of the antenna device 10A is not changed even when the antenna length of the antenna section 20 is changed.

This fact results in the following advantages. That is, the decrease in gain can be suppressed to be minimum, for example, even when the antenna length of the antenna section 20 is shortened. Further, it is possible to consequently improve the yield by adjusting the antenna length in the production step.

An experiment was carried out for the antenna device 10A according to the first embodiment in order to clarify the contents of the necessary antenna length. An illustrative experiment will be explained below.

Figure 4:
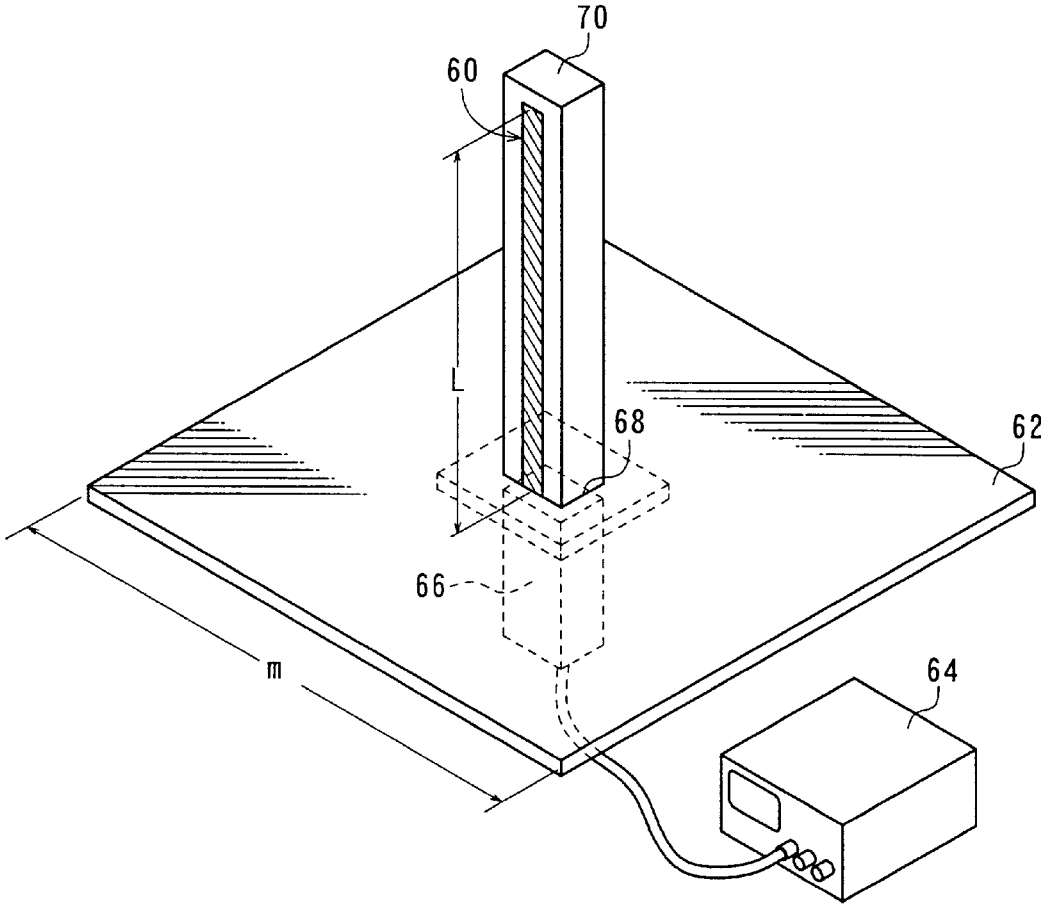
FIG. 4 illustrates a method for measuring the frequency characteristic of a single antenna.

At first, a single antenna 60 was evaluated in accordance with a measuring method shown in FIG. 4. As shown in FIG. 4, the measuring method was carried out as follows. That is, a hole 68 for allowing a connector 66 of a network analyzer 64 was bored through a central portion of a copper plate 62 having a planar square configuration. The single antenna 60 (antenna length=L) as a measurement objective was attached to a dielectric substrate 70 extending in the vertical direction of the connector 66. The length m of one side of the copper plate 62 was not less than 1.5 of the wavelength at the measurement frequency in vacuum.

Figure 5:
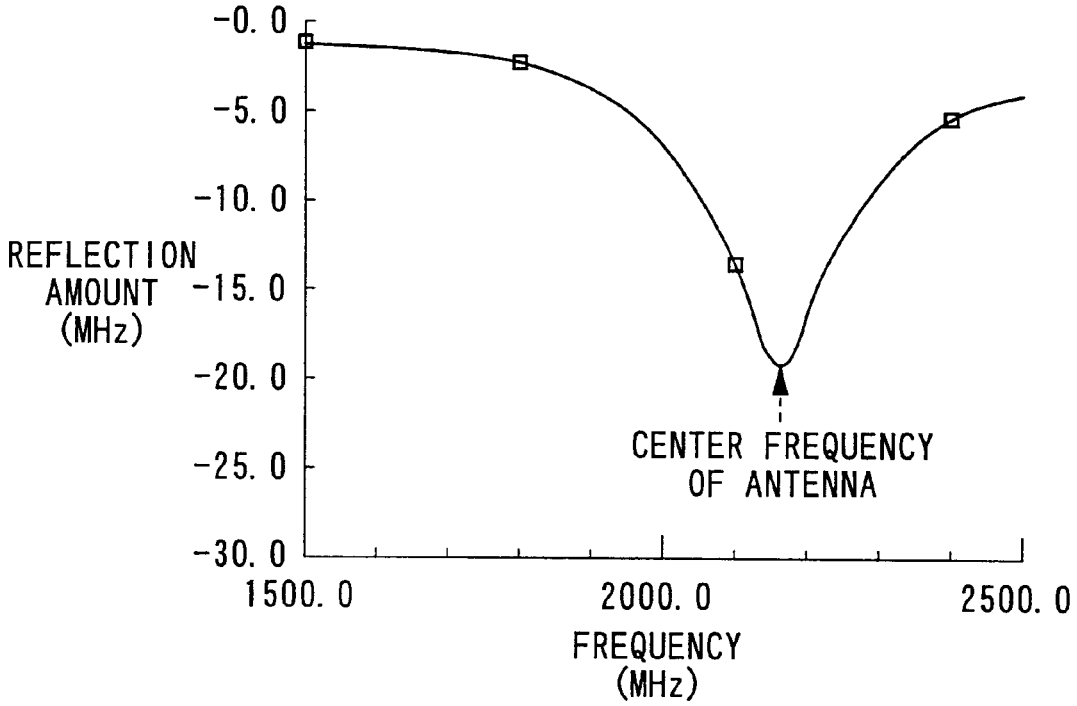
FIG. 5 shows a representative frequency characteristic of a single antenna.
Figure 6:
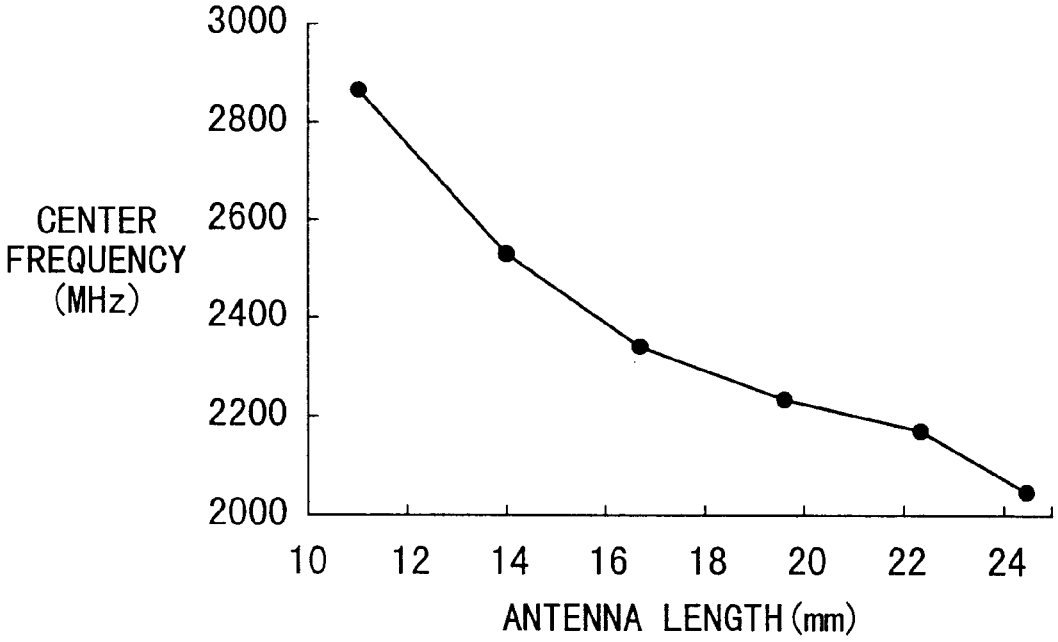
FIG. 6 shows a characteristic curve illustrating the change of the center frequency depending on the difference in antenna length of the single antenna.

The network analyzer 64 was used to measure the way of the change of center frequency when the antenna length L of the single antenna 60 was changed. FIG. 5 shows a representative frequency characteristic of the single antenna 60, and FIG. 6 shows the change of the center frequency depending on the difference in antenna length L.

In the case of an ordinary high frequency circuit, i.e., in the case of a circuit in which the antenna and the filter are not integrated into one unit, as shown in FIG. 5, the antenna length L is determined so that the frequency corresponding to the smallest reflection amount conforms to the frequency necessary for the circuit. Otherwise, as clarified from FIG. 5, the antenna would be used in a region in which the reflection amount is large, which would cause the output loss (loss of transmission of any transmission signal to the antenna) and the unnecessary oscillation.

On the contrary, in the case of the antenna device 10A according to the first embodiment, even when the antenna length is changed, the antenna gain (gain to indicate the degree of transmission of the signal (output) from the antenna to the outside) is not changed.

Figure 7:
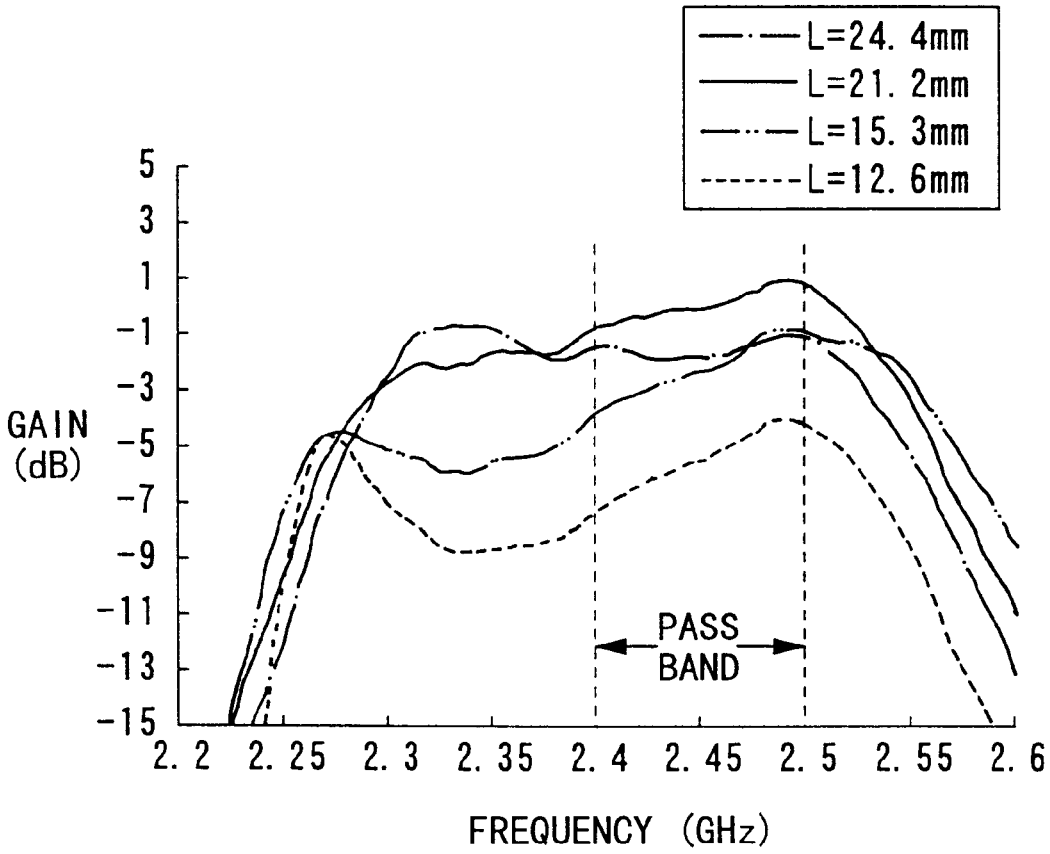
FIG. 7 shows characteristic curves illustrating the change of the antenna gain obtained by varying the antenna length in the antenna device according to the embodiment of the present invention.
Figure 8:
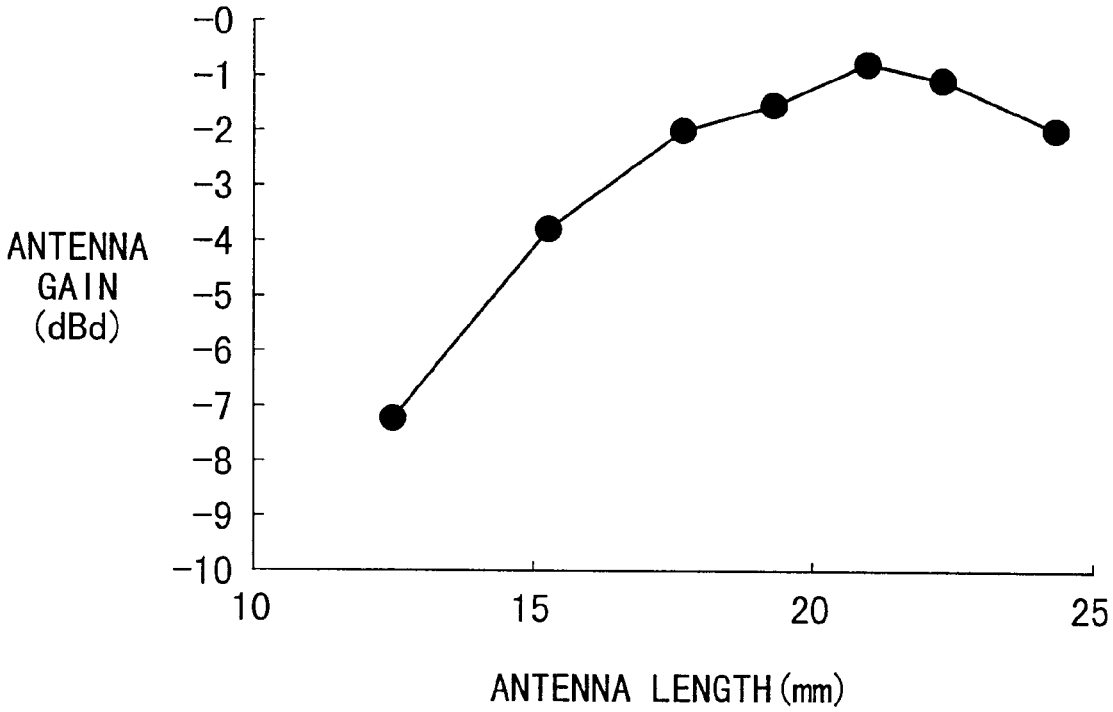
FIG. 8 shows a characteristic curve illustrating the relationship between the antenna gain and the antenna length in the pass band (2400 to 2500 MHz) of a filter section of the antenna device according to the embodiment of the present invention.
Figure 9:
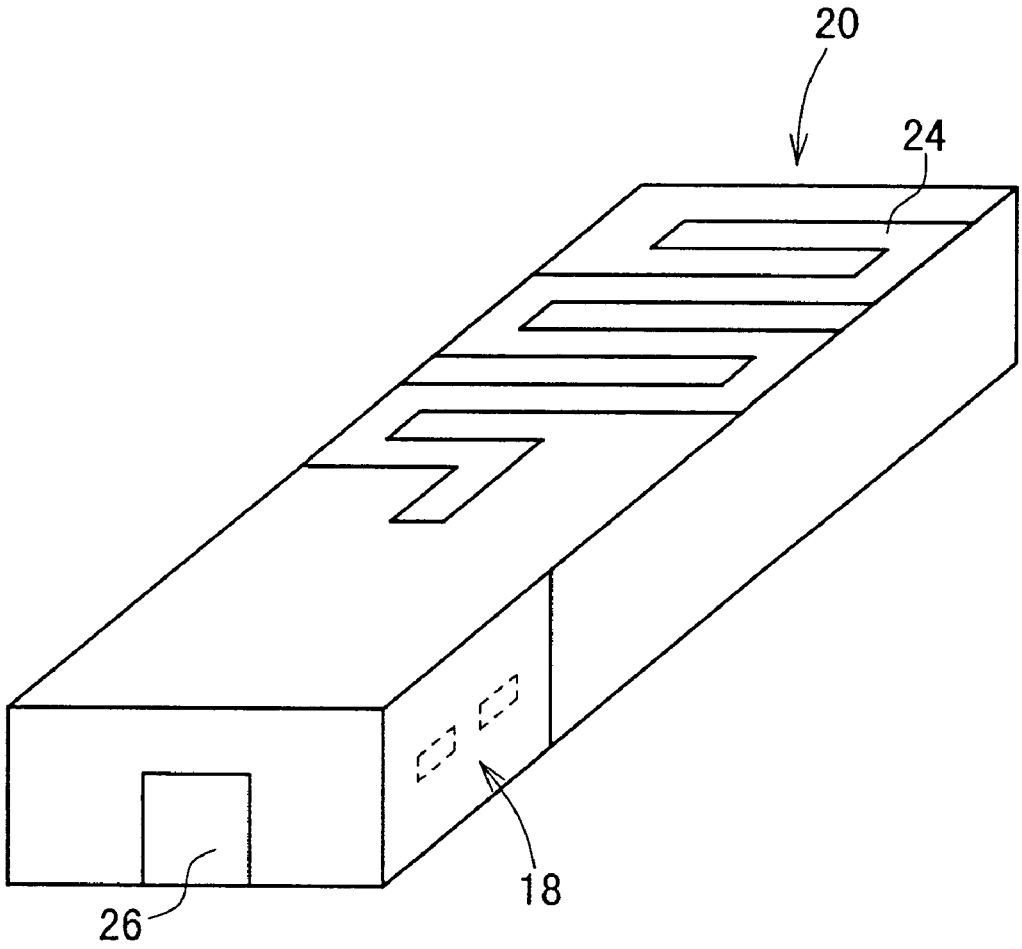
FIG. 9 shows a perspective view illustrating an antenna device according to a first modified embodiment.
Figure 10:
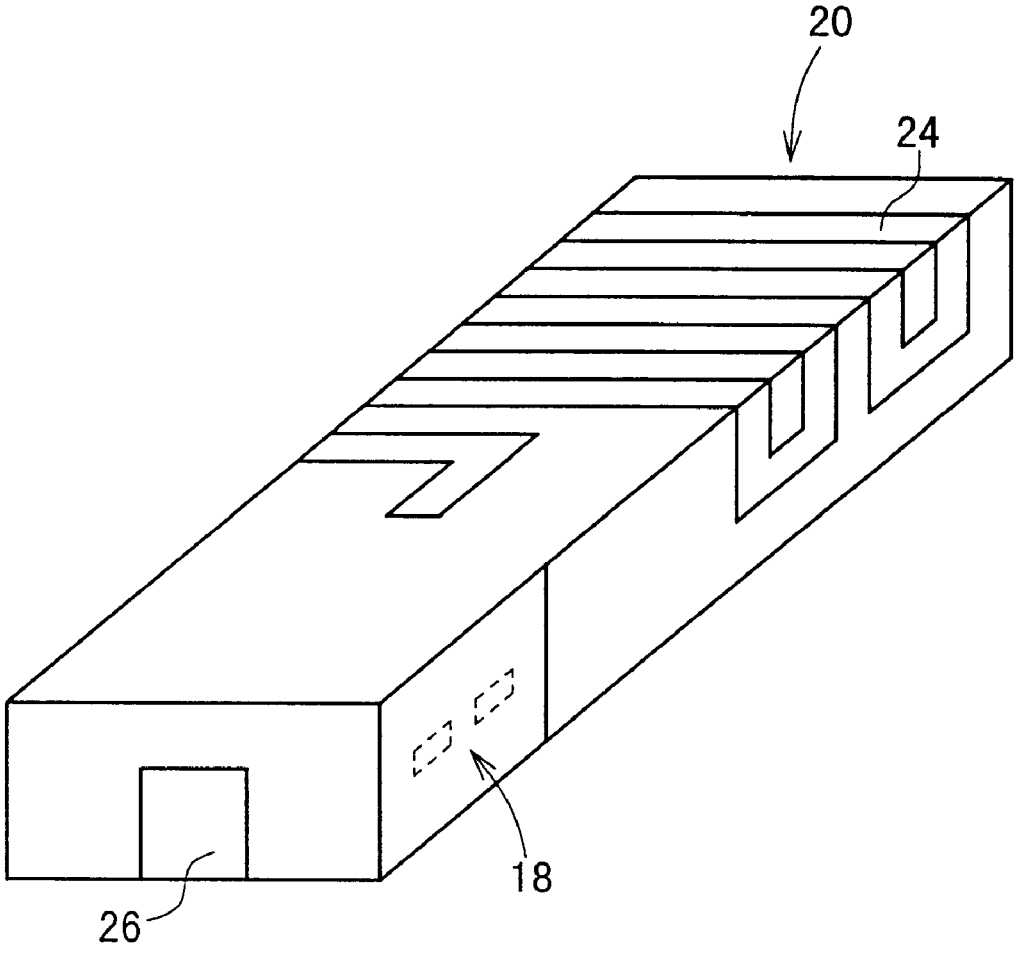
FIG. 10 shows a perspective view illustrating an antenna device according to a second modified embodiment.

This phenomenon will be explained with reference to FIGS. 7 and 8. In this example, it is assumed that the center frequency of the filter section 18 is 2450 MHz in the antenna device 10A according to the first embodiment (see FIGS. 1 and 2).

At first, the frequency characteristic was evaluated with only the single antenna before integrating the filter section 18 and the antenna section 20 into one unit. As a result, it was revealed that the antenna length L was required to be 21 mm in order to obtain the center frequency of 2450 MHz.

On the other hand, the antenna gain was measured while changing the antenna length L, after the filter section 18 and the antenna section 20 were integrated into one unit. An obtained result of the measurement is shown in FIG. 7. The relationship between the antenna gain and the antenna length L was investigated concerning the pass band (2400 to 2500 MHz) of the filter section 18 of the antenna device 10A. An obtained result is shown in FIG. 8.

When the single antenna having the antenna length L of 21 mm was shortened to have a length of 15.3 mm, the gain was deteriorated by about 8 dB. However, in the case of the antenna device 10A according to the first embodiment, even when the antenna length L of the antenna section 20 was shortened from 21 mm to 15.3 mm, the gain was deteriorated by only about 3 dB. Further it was revealed that when the antenna length L was shortened to 12.6 mm, the deterioration of the gain was suppressed to be 6 dB.

As described above, in the antenna device 10A according to the first embodiment, for example, even when the antenna length L of the antenna section 20 is shortened, it is possible to suppress the decrease in gain to be minimum. Further, the antenna length L can be adjusted during the production step, and hence it is possible to improve the yield of the antenna device 10A.

The embodiment described above is illustrative of the case in which the antenna 24, which has the meandering configuration with the width smaller than the width of the dielectric substrate 12, is formed on the upper surface of the dielectric substrate 12. Alternatively, as in an antenna device 10*a* according to a first modified embodiment shown in FIG. 9, it is also preferable to form an antenna 24 having a meandering configuration with approximately the same width as the width of the dielectric substrate 12. Further alternatively, as in an antenna device 10*b* according to a second modified embodiment shown in FIG. 10, it is also preferable that an antenna 24 may be overlapped with the both side surfaces of the dielectric substrate 12. Although not shown in the drawing, it is also preferable to use an antenna having a simple strip-shaped configuration.

Figure 11:
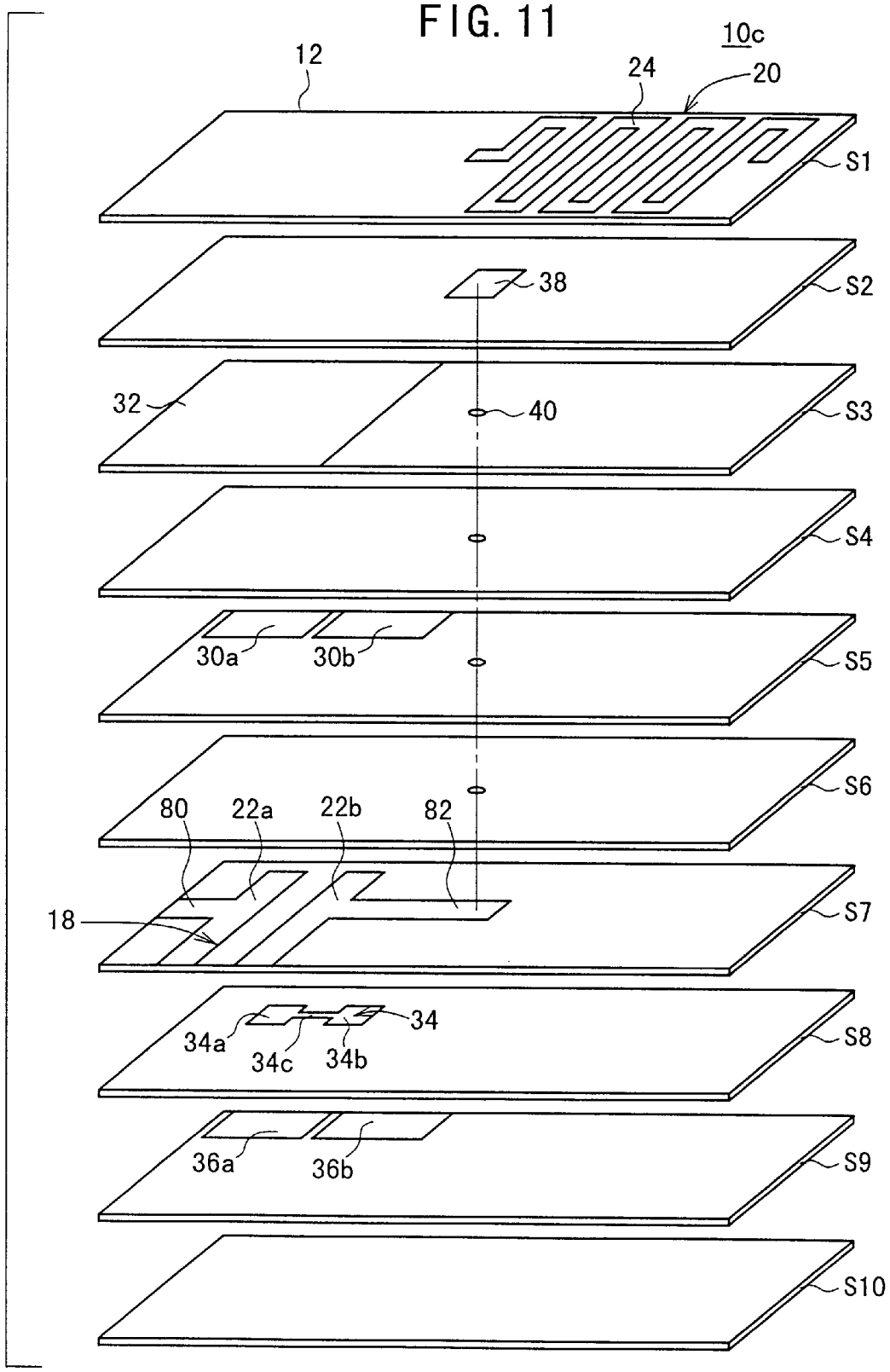
FIG. 11 shows an exploded perspective view illustrating an antenna device according to a third modified embodiment.

In the embodiments described above, the connection between the first resonator element 22*a* and the input/output terminal 26 is made by means of the capacitive coupling via the first input/output electrode 14 which is formed on the sixth dielectric layer S6, and the connection between the second resonator element 22*a* and the electrode 38 is made by means of the capacitive coupling via the second input/output electrode 16 which is formed on the sixth dielectric layer S6 as well. Alternatively, it is also possible to adopt an arrangement as shown in FIG. 11 (antenna device 10*c* according to a third modified embodiment).

Figure 12:
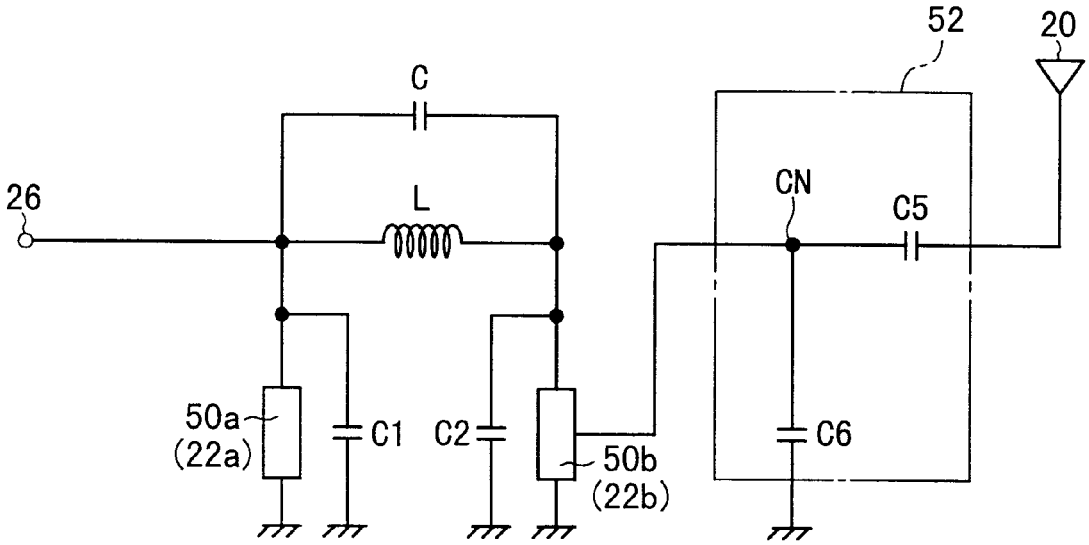
FIG. 12 shows an equivalent circuit diagram illustrating the antenna device according to the third modified embodiment.

That is, in the antenna device 10*c* according to the third modified embodiment, the first and second input/output electrodes 14, 16 are not formed on the sixth dielectric layer S6. In this preferred embodiment, the connection between the first resonator element 22*a* and the input/output terminal 26 is made by means of direct connection via a first connecting electrode 80 which is formed on the seventh dielectric layer S7, and the connection between the second resonator element 22*a* and the electrode 38 is made by means of direct connection via a second connecting electrode 82 which is formed on the seventh dielectric layer S7 as well. In this embodiment, it is possible to obtain a wide band width. FIG. 12 shows an equivalent circuit of the antenna device 10*c* according to the third modified embodiment.

Next, an antenna device 10B according to a second embodiment will be explained with reference to FIGS. 13 to 14B. Components or parts corresponding to those shown in FIG. 2 are designated by the same reference numerals, duplicate explanation of which will be omitted.

Figure 13:
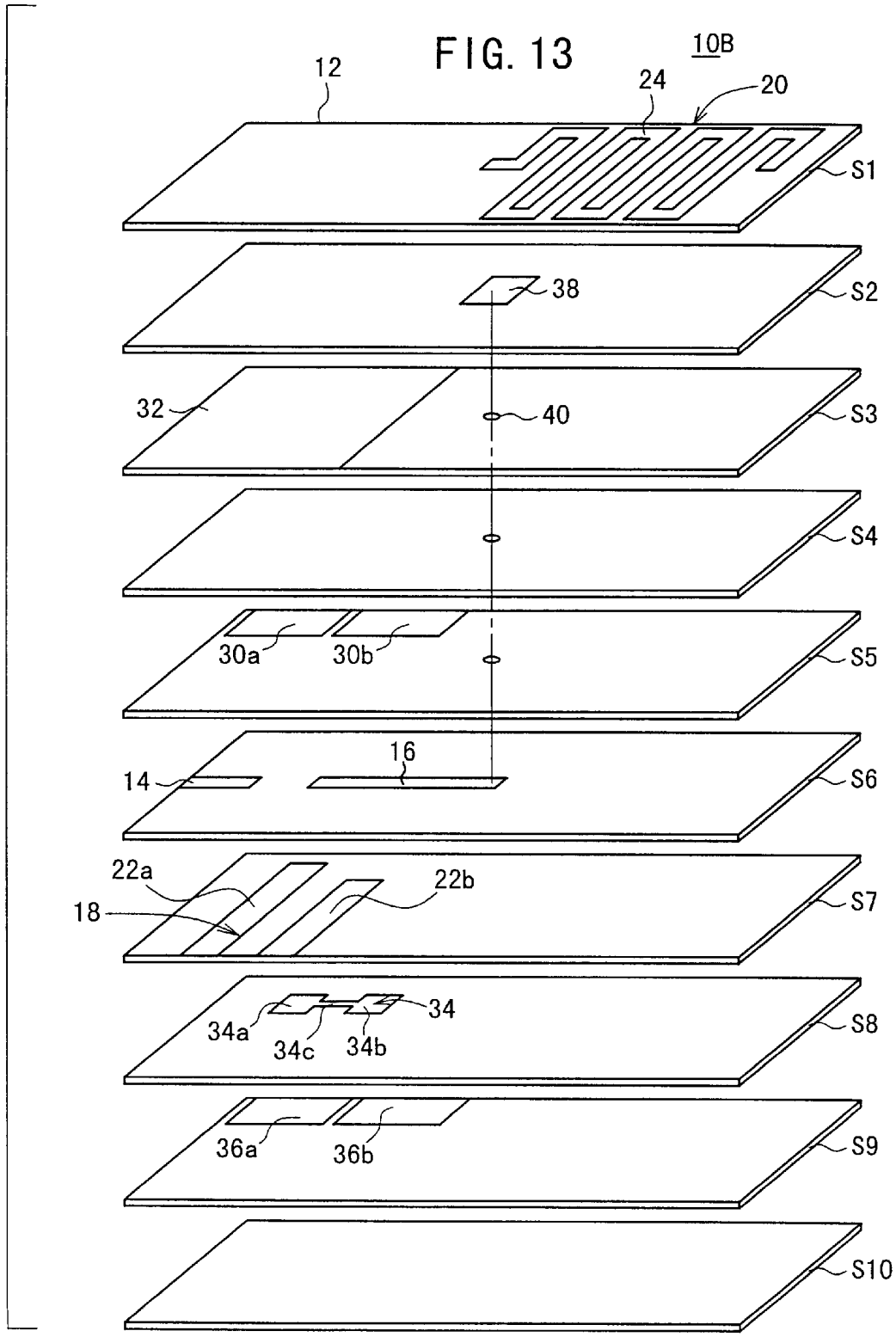
FIG. 13 shows an exploded perspective view illustrating an antenna device according to a second embodiment.

As shown in FIG. 13, the antenna device 10B according to the second embodiment is constructed in approximately the same manner as the antenna device 10A according to the first embodiment described above (see FIG. 2). However, in this embodiment, the length of the resonator element 11*a* disposed on the input side of the filter section 18 is different from the length of the second resonator element 22*b* disposed on the output side.

Figure 14A:
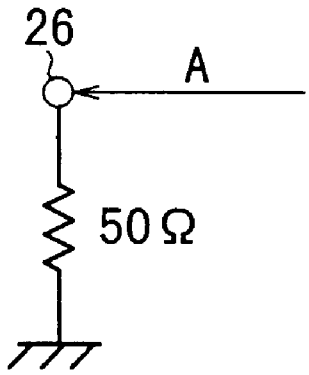
FIG. 14A illustrates an impedance as viewed from an arrow A concerning the equivalent circuit shown in FIG. 3.
Figure 14B:
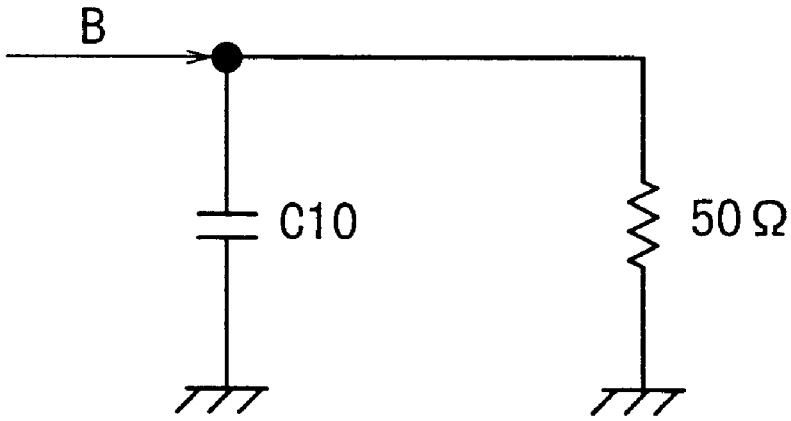
FIG. 14B illustrates an impedance as viewed from an arrow B concerning the equivalent circuit shown in FIG. 3.

Specifically, the length of the second resonator element 22*b* is designed to be shorter than the length of the first resonator element 22*a*. As a result, with reference to FIG. 3, the impedance, which is estimated when the left side (side of the input/output terminal 26) is viewed from the arrow A, is a characteristic impedance (50Ω) of an external circuit connected to the input/output terminal 26 as shown in FIG. 14A. On the other hand, the impedance, which is estimated when the right side (side of the antenna section 20) is viewed from the arrow B, is equivalent to an impedance obtained by connecting a capacitance C10 to the characteristic impedance (50Ω) in parallel as shown in FIG. 14B.

The capacitance C10 is added in parallel to the second resonator 50*b* based on the second resonator element 22*b*. Therefore, the resonance frequency differs between the first and second resonators 50 *a*, 50 *b*. In order to compensate the difference, the second resonator element 22*b* is made to be shorter than the first resonator element 22*a* as shown in FIG. 13. Thus, it is possible to set the first and second resonators 50 *a*, 50*b* to have an identical resonance frequency.

As described above, in the antenna device 10B according to the second embodiment, it is possible to counteract the difference in resonance frequency between the respective resonators 50 *a*, 50*b*, which would be otherwise caused by the mismatch between the respective impedances on the side of the antenna section 20 and the side of the external circuit of the filter section 18. Thus, it is possible to obtain the filter section 18 having a good attenuation characteristic. This results in realization of a high quality of the antenna device 10B.

Next, explanation will be made for a method for producing the antenna devices 10A and 10B according to the first and second embodiments. The antenna devices 10A and 10B according to the first and second embodiments include the various electrodes which are internally mounted (contained) in the substrate 12. Therefore, it is preferable that those used for the electrodes have little loss with a low specific resistance.

Those preferably used as the dielectric are highly reliable with a wide range of selection of dielectric constant. That is, it is preferable to use a ceramic dielectric. In this case, it is possible to effectively realize a small size of each filter.

The following production method is desirably adopted. That is, a conductive paste is applied to a ceramic powder green sheet to form an electrode pattern. After that, various green sheets are stacked with each other, followed by sintering to obtain a dense structure which is integrated with a ceramic dielectric in a state in which the conductor is stacked at the inside.

When a conductor based on Ag or Cu is used, it is difficult to perform the simultaneous sintering together with the ordinary dielectric material, because such a conductor has a low melting point. Therefore, it is necessary to use a dielectric material which can be sintered at a temperature lower than the melting point (not more than 110° C.) of such a conductor.

In view of the feature of the device to be used as a microwave filter, it is preferable to use a dielectric material with which the temperature characteristic (temperature coefficient) of the resonance frequency of the resonance circuit to be formed is not more than ±50 ppm/° C.

Those usable as such a dielectric material include, for example, those based on glass such as a mixture of cordierite-based glass powder, $TiO_2$ powder, and $Nd_2Ti_2O_7$ powder, those obtained by adding a slight amount of glass-forming component or glass powder to $BaO—TiO_2—Re_2O_3—Bi_2O_3$-based composition (Re: rare earth component), and those obtained by adding a slight amount of glass powder to barium oxide-titanium oxide-neodymium oxide-based dielectric magnetic composition powder.

For example, a powder mixture is obtained by sufficiently mixing 73 wt % of glass powder having a composition of MgO (18 wt %)-$Al_2O_3$ (37 wt %)-$SiO_2$ (37 wt %)-$B_2O_3$ (5 wt %)-$TiO_2$ (3 wt %), 17 wt % of commercially available $TiO_2$ powder, and 10 wt % of $Nd_2Ti_2O_7$ powder.

The material used as the $Nd_2Ti_2O_7$ powder is obtained by calcining $Nd_2O_3$ powder and $TiO_2$ powder at 1200° C., followed by pulverization.

In the method for producing the antenna devices 10A and 10B according to the first and second embodiments, an acrylic organic binder, a plasticizer, and a solvent based on toluene and alcohol are added to the powder mixture described above, followed by sufficient mixing with alumina cobblestone to obtain a slurry. The slurry is used to produce a green tape having a thickness of 0.2 mm to 0.5 mm in accordance with the doctor blade method.

Subsequently, the green tape is punched and processed into a desired shape. After that, the conductor patterns shown in FIGS. 1 and 2 are printed with a silver paste as the conductive paste respectively. Subsequently, necessary green tapes, which are required to adjust the thickness of the green tapes printed with the conductor patterns, are stacked and superimposed to give the structure as shown in FIGS. 1 and 2, and they are laminated with each other, followed by sintering, for example, at 900° C. to produce the dielectric substrate 12.

The pattern of the antenna 24 is printed on the upper surface of the dielectric substrate 12 constructed as described above. The patterns of the ground electrodes 28 are printed on the both side surfaces of the dielectric substrate 12. The printed patterns are heat-treated at 850° C.

When the production method described above is adopted, it is possible to easily produce the antenna device 10 comprising the filter section 18 and the antenna section 16 which are integrated into one unit with the capacitance intervening therebetween in the single dielectric substrate 12.

It is a matter of course that the antenna device according to the present invention is not limited to the embodiments described above, which may be embodied in other various forms without deviating from the gist or essential characteristics of the present invention.

As explained above, according to the antenna device concerning the present invention, it is possible to suppress the decrease in gain to be minimum, for example, even when the antenna length of the antenna section is shortened. Further, the antenna length can be adjusted in the production step. Therefore, it is possible to improve the yield of the antenna device.

What is claimed is:

1. An antenna device comprising:

an antenna section;

a filter section, said antenna section and said filter section being formed integrally in a dielectric substrate formed from a plurality of stacked dielectric layers; and a capacitance, comprising at least one of said dielectric layers, disposed between said antenna section and said filter section;

wherein said antenna section and said filter section are coupled to one another via said capacitance.

2. The antenna device according to claim 1, wherein $0.3 \times Lr \leqq Lt \leqq 1.2 \times Lr$ is satisfied provided that an antenna length of said antenna section is Lt, and an antenna length measured for a single antenna is Lr.

3. The antenna device according to claim 2, wherein said antenna length Lt of said antenna section satisfies $0.6 \times Lr \leqq Lt \leqq 1.2 \times Lr$.

4. The antenna device according to claim 3, wherein said antenna length Lt of said antenna section satisfies $0.75 \times Lr \leqq Lt \leqq Lr$.

5. The antenna device according to claim 1, wherein an antenna for constructing said antenna section is a monopole antenna.

6. The antenna device according to claim 1, wherein an antenna for constructing said antenna section is an antenna having a meander line configuration.

7. The antenna device according to claim 1, wherein an antenna for constructing said antenna section is an antenna having a helical configuration.

8. The antenna device according to claim 1, wherein a length of a resonator disposed on an input side of said filter section is different from a length of a resonator disposed on an output side.

9. An antenna device according to claim 1, further comprising at least one ground electrode formed on a side surface of said filter section.

10. An antenna device comprising an antenna section and a filter section which are formed integrally in a dielectric substrate, wherein:

said antenna section and said filter section are coupled to one another via a capacitance; and wherein a length of a resonator disposed on an input side of said filter section is different from a length of a resonator disposed on an output side.

* * * * *